US006375763B1

(12) United States Patent
Yokoyama et al.

(10) Patent No.: US 6,375,763 B1
(45) Date of Patent: Apr. 23, 2002

(54) PEARLITIC STEEL RAILROAD RAIL

(75) Inventors: Hiroyasu Yokoyama; Shinji Mitao, both of Fukuyama (JP)

(73) Assignee: NKK Corporation, Tokyo (JP)

( * ) Notice: Subject to any disclaimer, the term of this patent is extended or adjusted under 35 U.S.C. 154(b) by 0 days.

(21) Appl. No.: 09/572,165

(22) Filed: May 17, 2000

(30) Foreign Application Priority Data

Jun. 2, 1999 (JP) ..... 11-155117

(51) Int. Cl.[7] ..... C22C 38/12; C22C 38/26; C22C 38/48

(52) U.S. Cl. ..... 148/320; 420/127; 420/110; 420/104; 420/119

(58) Field of Search ..... 148/320, 581; 420/127, 110, 104, 119

(56) References Cited

U.S. PATENT DOCUMENTS 4,714,500 A * 12/1987 Heller et al. ..... 148/584

4,933,024 A * 6/1990 Fukuda et al. ..... 148/584

FOREIGN PATENT DOCUMENTS

| | | |
|---|---|---|
| JP | 8-109439 A | 4/1996 |
| JP | 8-144016 A | 6/1996 |
| JP | 8-246100 A | 9/1996 |
| JP | 8-246101 A | 9/1996 |

* cited by examiner

*Primary Examiner*—Deborah Yee
(74) *Attorney, Agent, or Firm*—Frishauf, Holtz, Goodman, Langer & Chick, P.C.

(57) ABSTRACT

A pearlitic steel railroad rail which comprises 0.75 to 0.84% C, 0.10 to 1.0% Si, 0.4 to 2.5% Mn, 0.035% or less P, 0.035% or less S, and 0.05 to 0.6% Nb, by weight. This rail has better wear resistance than the heretofore used pearlitic steel rail and sufficient ductility so cracks do not appear due to thermal dilation and contraction caused by a change of temperature. The rail is consequently very suitable for the use in a mine railroad.

20 Claims, 2 Drawing Sheets

PEARLITIC STEEL RAILROAD RAIL

BACKGROUND OF THE INVENTION

1. Field of the Invention

The present invention relates to a pearlitic steel railroad rail used, for example, in a mine railroad, in particular having excellent wear resistance.

2. Description of Related Art

Since freight cars used in a mine railroad sometimes make a sharp turn carrying mainly heavy minerals, the wheel axle of these cars is overloaded compared with that of passenger cars, and therefore the railroad rail for this use is exposed to severe conditions. From this viewpoint, the rail used in a mine railroad is fabricated from so-called pearlitic steel consisting essentially of pearlitic structure which is desirable for wear resistance.

With a recent increase in loading weight in freight cars due to an improvement of railroading efficiency, further excellent wear resistance is requested for the rail in a mine railroad. To answer the request, the Japanese Unexamined Patent Publications No. 8-109439 and No 8-144016 propose a railroad rail prepared from hypereutectoid steel containing more than 0.85% of C in which the ratio of cementitic structure, an important factor giving excellent wear resistance to pearlitic steel, is increased. The Japanese Unexamined Patent Publications No 8-246100 and No 8-246101 disclose a railroad rail fabricated from hypereutectoid steel in which the pearlitic structure is hardened in the head part of rail by heat treatment.

However, in the railroad rails described in these Patent Publications, there sometimes appear cracks due to the thermal dilation and contraction caused by a change of atmospheric temperature, for example, over 80° C. in summer and below 30° C. in winter, because the ductility of the rail fabricated from hypereutectoid steel is very poor. Furthermore, if the rail is applied to a long rail with a length of 200~1500 m, of which the demand is increasing in recent time, cracks tend to generate in the welded part because of its large thermal contraction compared with the case of the rail having a conventional length.

SUMMARY OF THE INVENTION

An object of the present invention is consequently to provide a pearlitic steel railroad rail having not only excellent wear resistance but also sufficient ductility to prevent the cracks from generating due to a temperature difference.

The above object can be achieved by the pearlitic steel railroad rail which comprises 0.75 to 0.84% C, 0.10 to 1.0% Si, 0.4 to 2.5% Mn, 0.035% or less P, 0.035% or less S and 0.05 to 0.5% Nb, by weight.

DETAILED DESCRIPTION OF THE INVENTION

Figure 1:
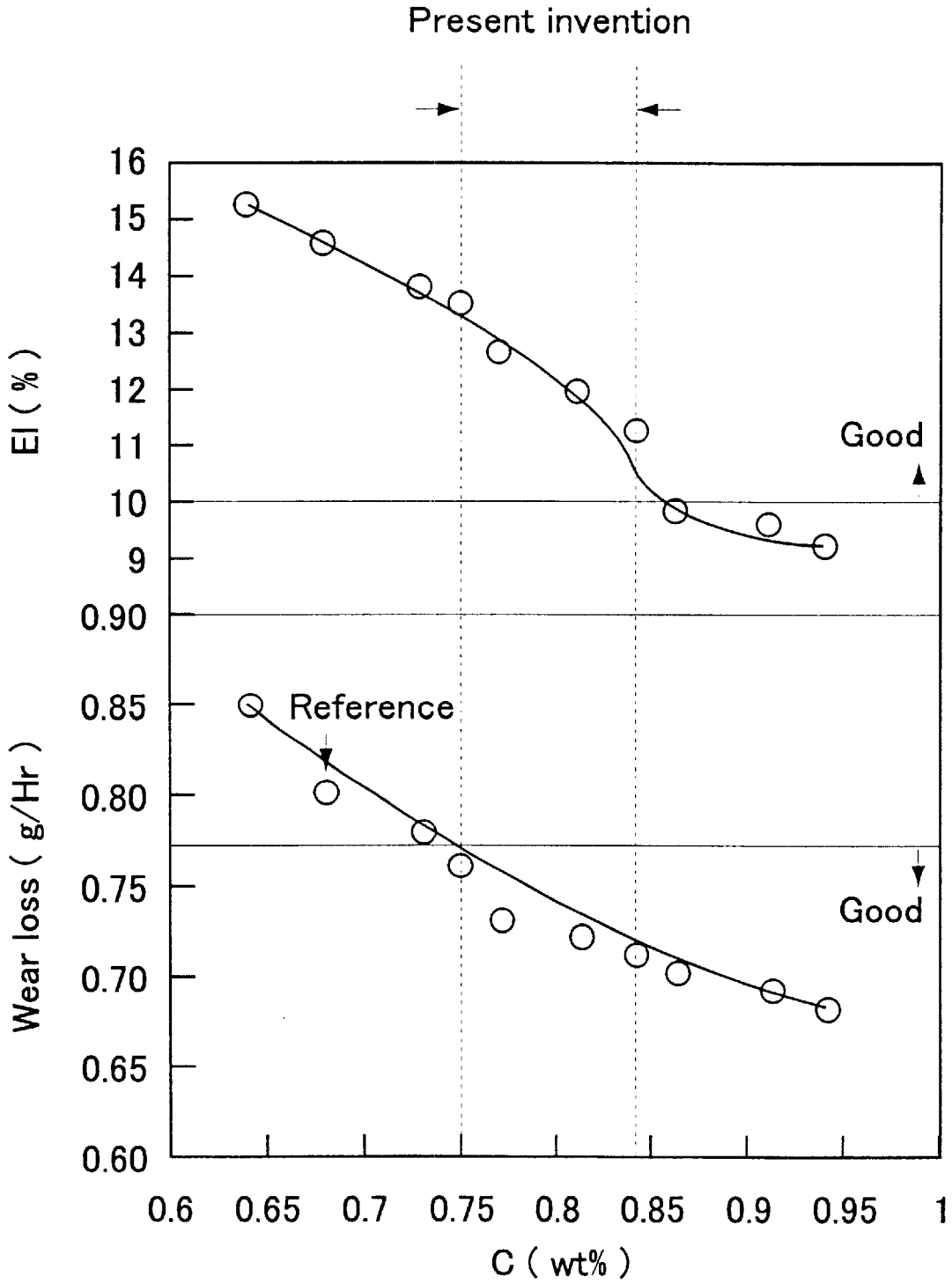
FIG. 1 is a graph showing the relationship between the content of C and the wear loss and the El (Elongation)

The above specification of the content of chemical compositions contained in the pearlitic steel railroad rail of the present invention is based on the reasons as described below.

Carbon: Carbon is an important element contributing to wear resistance. An increase in the carbon content leads to an improvement of wear resistance. However, if the carbon content is less than 0.75%, better wear resistance than that of the actually used pearlitic steel rail is not obtained. If the carbon content exceeds 0.84%, the ductility of steel degrades because proeutectoid cementites precipitate on the γ boundary during pearlitic transformation after hot rolling. Accordingly, the carbon content is specified to a range from 0.75 to 0.84%.

Silicon: 0.1% or more of silicon is needed as a deoxidizer of steel. However, more than 1.0% of silicon deteriorates the weldability of steel because of its strong affinity with oxygen. Thus, the content of silicon is specified to a range from 0.1 to 1.0%.

Manganese: Since manganese is effective to an improvement of the ductility of steel and also contributes to an increase of the strength of steel by lowering the pearlitic transformation temperature, the lower limit of manganese is restricted to 0.4%. In contrast, when the manganese content exceeds 2.5%, the steel becomes very brittle after heat treatment or welding because the microsegregation of manganese promotes a formation of martensitic structure. Consequently, the manganese content is specified to a range from 0.4 to 2.5%. Phosphorus: When phosphorus is added in a content exceeding 0.035%, the toughness of steel degrades. Therefore, the phosphorus content is specified to 0.035% or less.

Sulfer: Sulfer exists particularly as inclusions in steel. If the sulfer content exceeds 0.035%, the ductility of steel becomes low because of a considerable increase in inclusions. Thus, the sulfer content is limited to not more than 0.035%.

Niobium: Niobium forms a fine carbide with carbon during or after hot rolling, increases the strength of steel up to the inside of rail head owing to precipitation hardening mechanism and consequently improves wear resistance to a great extent, contributing to a long life of rail. In addition, finely dispersed carbides in the matrix of steel promote a formation of fine pearlitic colonies and therefore significantly improve the ductility of steel. If the niobium content is less than 0.05%, the effect of niobium addition becomes less. If the niobium content exceeds 0.5%, the weldability degrades. Accordingly, the niobium content is specified to a range from 0.05 to 0.5%.

The Nb content is preferably 0.05 to 0.2%, taking a production cost into consideration. In this case, the balance must consist essentially of Fe so that the Nb addition comes into effect.

Furthermore, the addition of one element or more selected from 1.5% or less Cr, 1% or less Cu, 1% or less Ni and 1% or less Mo improves the wear resistance of the rail. The following reasons are given to the upper limit of these elements.

Chromium: If the chromium content exceeds 1.5%, the weldability of steel degrades.

Copper: More than 1% of copper promotes a generation of the cracks characterized by the copper addition.

Nickel: Nickel is effective to an increase in the strength of steel according to solid solution hardening mechanism, an improvement of the toughness of steel and a suppression of the cracks characterized by the copper addition. If the nickel content exceeds 1%, the effect of nickel addition becomes saturated.

Molybdenum: The molybdenum content exceeding 1% brings about a degradation of the wear resistance of rail since the excess of molybdenum forms a bainitic structure.

EXAMPLE 1

Steels Nos. through 1-1 to 1-25 having the chemical compositions shown in Table 1 were heated to 1250° C., then hot rolled to rails at 920° C. and finally cooled at a cooling rate of 0.5 to 3° C./sec.

Thus obtained rails were subjected to the measurements of wear resistance, ductility and hardness, of which the methods are described below.

1) Wear resistance: The Nishihara type wear test piece with a diameter of 30 mm was taken from the head of each rail. Wear loss of the test piece after 100,000 rotations was measured in a dry atmosphere at a contact load of 1.4 GPa and a sliding ratio of 10%, using a Nishihara type wear tester. When the tested rail showed a decrease of wear loss by 3% or more to the wear loss of the actually used pearlitic steel rail, the rail was evaluated to be good, namely be invented.
2) Elongation: The total elongation (El) was measured by the tensile test, using ASTM test piece (diameter of parallel portion: 9 mm, gauge length: 36 mm). In the chapter 4. "Rail" of AREA (American Railway Engineering Association, 1992 ), it is prescribed that 10% or more of the El is required, which certainly makes it possible to prevent the generation of cracks in the welded part of long rails.
3) Hardness: The measurement of Vickers hardness (Hv) was effectuated at a load of 10 Kgf on the portion located at a depth of 5 mm from the head of rail. In the chapter 4. "Rail" of AREA, the standard of Hv is prescribed to be in a range from 340 to 399.

FIG. 1 shows the relationship between the content of C and the wear loss and the El. It can be found that if the C content is 0.75 to 0.84%, decrease of wear loss by 3% or more to the wear loss of the actually used pearlitic steel rail ("Reference" in the figure) and 10% or more of the El are obtained.

As shown in Table 2, the rails fabricated from the steels 1-4 to 1-7, 1-12, 1-15 to 1-17 and 1-20 having the C content of the present invention are excellent in wear resistance and ductility since they show a decrease of wear loss by 3% or more to the wear loss of the Reference 1-25 and 10% or more of the El. The Hv of the rails of the present invention is in the range from 340 to 399, meeting the standard requirement of AREA.

On the other hand, in the rails fabricated from the steel 1-11 having less than 0.10% of Si and the Steel 1-13 with the Mn content less than 0.4%, the wear resistance degrades because of the insufficient hardness.

TABLE 1

(wt %)

| Steel | C | Si | Mn | Nb | Cr | Cu | Ni | Mo | Note |
|---|---|---|---|---|---|---|---|---|---|
| 1-1 | 0.64 | 0.25 | 0.953 | 0.07 | 0.20 | — | — | — | Comparison |
| 1-2 | 0.68 | 0.26 | 0.955 | 0.09 | — | — | — | — | Comparison |
| 1-3 | 0.73 | 0.25 | 0.957 | 0.12 | 0.21 | — | — | — | Comparison |
| 1-4 | 0.75 | 0.35 | 0.952 | 0.11 | — | — | — | — | Invention |
| 1-5 | 0.77 | 0.25 | 0.951 | 0.09 | 0.25 | — | — | — | Invention |
| 1-6 | 0.81 | 0.45 | 0.956 | 0.07 | — | — | — | — | Invention |
| 1-7 | 0.84 | 0.25 | 0.958 | 0.06 | 0.20 | — | — | — | Invention |
| 1-8 | 0.86 | 0.26 | 0.954 | 0.09 | — | — | — | — | Comparison |
| 1-9 | 6.91 | 0.25 | 0.956 | 0.12 | — | — | — | — | Comparison |
| 1-10 | 0.94 | 0.53 | 1.150 | 0.08 | 0.03 | — | — | — | Comparison |
| 1-11 | 0.79 | 0.08 | 0.953 | 0.11 | — | — | — | — | Comparison |
| 1-12 | 0.82 | 0.91 | 0.955 | 0.09 | — | — | — | — | Invention |
| 1-13 | 0.84 | 0.25 | 0.340 | 0.12 | — | — | — | — | Comparison |
| 1-14 | 0.77 | 0.09 | 0.390 | 0.11 | — | — | — | — | Comparison |
| 1-15 | 0.79 | 0.25 | 0.951 | 0.09 | — | 0.25 | 0.12 | — | Invention |
| 1-16 | 0.81 | 0.29 | 0.956 | 0.08 | — | — | — | 0.34 | Invention |
| 1-17 | 0.84 | 0.23 | 0.958 | 0.10 | — | — | — | — | Invention |
| 1-18 | 0.86 | 0.26 | 0.370 | 0.09 | 0.22 | 0.21 | 0.19 | — | Comparison |
| 1-19 | 0.88 | 1.05 | 0.956 | 0.12 | — | — | — | — | Comparison |
| 1-20 | 0.83 | 0.24 | 0.450 | 0.14 | — | — | — | 0.29 | Invention |
| 1-21 | 0.65 | 0.31 | 2.610 | 0.13 | — | — | — | — | Comparison |
| 1-22 | 0.61 | 0.31 | 1.030 | 0.14 | — | — | 1.06 | — | Comparison |
| 1-23 | 0.71 | 0.29 | 1.140 | 0.13 | 1.59 | — | — | — | Comparison |
| 1-24 | 0.62 | 0.34 | 0.990 | 0.15 | — | — | — | 0.15 | Comparison |
| 1-25 | 0.68 | 0.28 | 0.960 | — | — | — | — | — | Reference |

TABLE 2

| Steel | Wear loss [g/Hr] | {Wear loss(S)* − Wear loss(R)**} × 100/Wear loss(R) [%] | Hv | El (%) | Note |
|---|---|---|---|---|---|
| 1-1 | 0.85 | 6.25 | 358 | 15.5 | Comparison |
| 1-2 | 0.80 | 0 | 362 | 15.1 | Comparison |
| 1-3 | 0.78 | −2.50 | 368 | 14.7 | Comparison |
| 1-4 | 0.76 | −5.00 | 374 | 13.8 | Invention |
| 1-5 | 0.73 | −8.75 | 376 | 13.1 | Invention |
| 1-6 | 0.72 | −10.00 | 380 | 12.4 | Invention |
| 1-7 | 0.71 | −11.25 | 384 | 11.4 | Invention |
| 1-8 | 0.70 | −12.50 | 387 | 9.8 | Comparison |
| 1-9 | 0.69 | −13.75 | 391 | 9.5 | Comparison |
| 1-10 | 0.68 | −15.00 | 397 | 9.1 | Comparison |
| 1-11 | 0.78 | −2.50 | 339 | 14.5 | Comparison |
| 1-12 | 0.77 | −3.75 | 376 | 13.2 | Invention |
| 1-13 | 0.80 | 0 | 341 | 14.1 | Comparison |
| 1-14 | 0.85 | 6.25 | 371 | 11.8 | Comparison |
| 1-15 | 0.73 | −8.75 | 388 | 11.5 | Invention |
| 1-16 | 0.71 | −11.25 | 378 | 12.9 | Invention |
| 1-17 | 0.70 | −12.50 | 382 | 11.7 | Invention |
| 1-18 | 0.75 | −6.25 | 367 | 9.8 | Comparison |
| 1-19 | 0.69 | −13.75 | 382 | 9.6 | Comparison |
| 1-20 | 0.71 | −11.25 | 385 | 12.1 | Invention |
| 1-21 | 0.81 | 1.25 | 371 | 12.8 | Comparison |
| 1-22 | 0.81 | 1.25 | 389 | 12.4 | Comparison |
| 1-23 | 0.81 | 1.25 | 386 | 12.6 | Comparison |
| 1-24 | 0.85 | 6.25 | 388 | 12.3 | Comparison |
| 1-25 | 0.80 | 0 | 375 | 12.5 | Reference |

*Wear loss of Steel 1−1~1−24
**Wear loss of Steel 1-25

EXAMPLE 2

Steels Nos. through 2-1 to 2-11 having the various Nb contents shown in Table 3 were heated to 1280° C., then hot rolled to rails at 950° C. and finally cooled at a cooling rate of 0.5 to 3° C./sec.

Thus obtained rails were subjected to the same measurements as described in Example 1.

Figure 2:
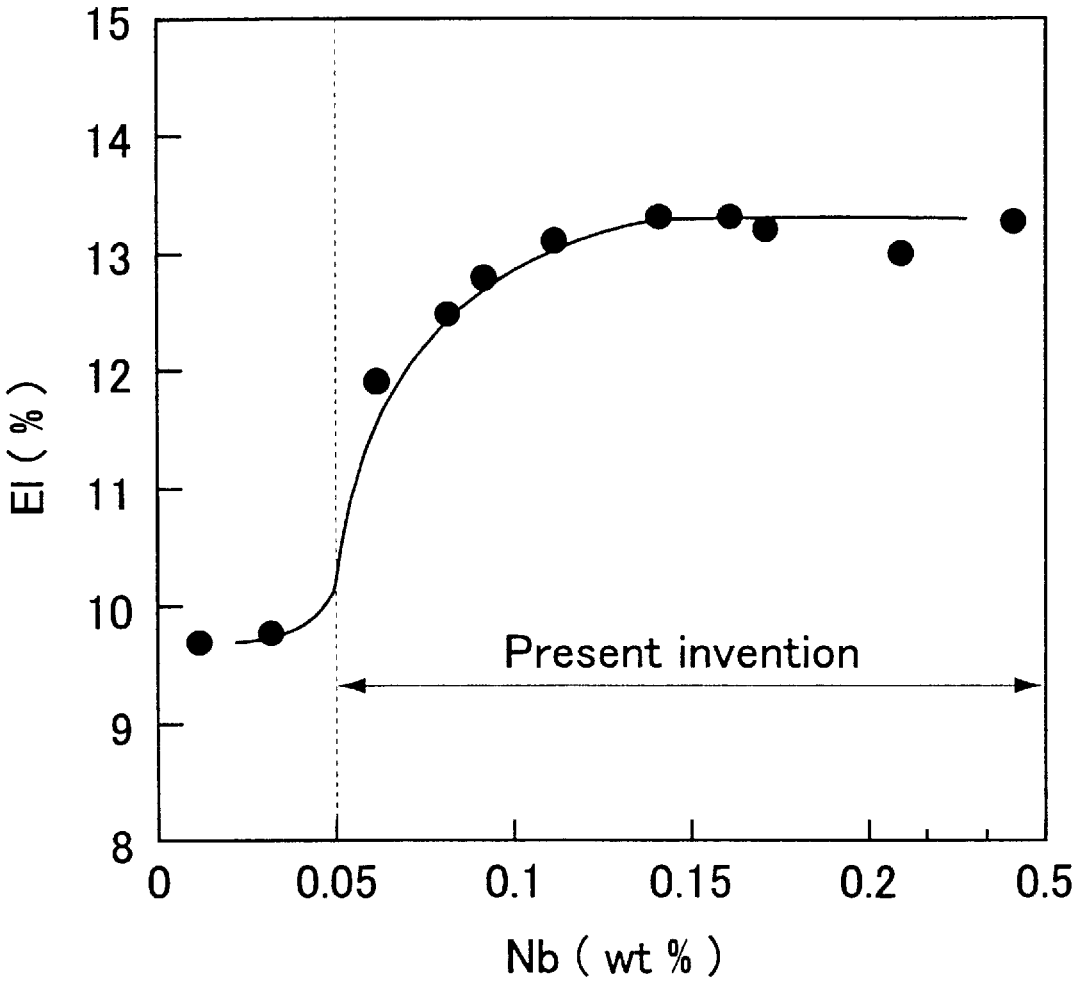
FIG. 2 is a graph showing the relationship between the content of Nb and the El.

As shown in Table 4 and FIG. 2, the rails fabricated from the steels having the Nb content of 0.05 to 0.5% are excellent in wear resistance and ductility since they show a decrease of wear loss by 3% or more to the wear loss of the Reference 1-25 and 10% or more of the El. The Hv of these rails is in the range from 340 to 399, satisfying the standard requirement of AREA.

In contrast, the rails fabricated from the steels 2-1 and 2-2 having a small content of Nb exhibit a poor ductility, the elongation being less than 10%.

Since the effect of the addition of Nb saturates in the range above 0.2% as shown in FIG. 2, the Nb content is preferably 0.05 to 0.2%, taking a production cost into account.

TABLE 3

| Steel | C | Si | Mn | (wt %) Nb | Note |
|---|---|---|---|---|---|
| 2-1 | 0.83 | 0.34 | 0.88 | 0.01 | Comparison |
| 2-2 | 0.84 | 0.32 | 1.03 | 0.03 | Comparison |
| 2-3 | 0.82 | 0.33 | 0.85 | 0.06 | Invention |
| 2-4 | 0.83 | 0.31 | 1.08 | 0.08 | Invention |
| 2-5 | 0.84 | 0.32 | 0.89 | 0.09 | Invention |
| 2-6 | 0.83 | 0.35 | 0.95 | 0.11 | Invention |
| 2-7 | 0.82 | 0.28 | 0.97 | 0.14 | Invention |
| 2-8 | 0.81 | 0.31 | 0.94 | 0.16 | Invention |
| 2-9 | 0.79 | 0.33 | 0.99 | 0.17 | Invention |
| 2-10 | 0.82 | 0.34 | 1.00 | 0.21 | Invention |
| 2-11 | 0.81 | 0.31 | 0.95 | 0.45 | Invention |

TABLE 4

| Steel | Wear loss [g/Hr] | {Wear loss(S)* − Wear loss(R)**} × 100/Wear loss(R) [%] | Hv | El (%) | Note |
|---|---|---|---|---|---|
| 2-1 | 0.75 | −6.25 | 376 | 9.7 | Comparison |
| 2-2 | 0.76 | −5.00 | 377 | 9.8 | Comparison |
| 2-3 | 0.76 | −5.00 | 376 | 13.1 | Invention |
| 2-4 | 0.75 | −6.25 | 378 | 13.4 | Invention |
| 2-5 | 0.75 | −6.25 | 376 | 13.2 | Invention |
| 2-6 | 0.76 | −5.00 | 377 | 13.4 | Invention |
| 2-7 | 0.76 | −5.00 | 385 | 13.3 | Invention |
| 2-8 | 0.76 | −5.00 | 388 | 13.3 | Invention |
| 2-9 | 0.75 | −6.25 | 387 | 13.2 | Invention |
| 2-10 | 0.75 | −6.25 | 385 | 13.0 | Invention |
| 2-11 | 0.75 | −6.25 | 388 | 13.1 | Invention |

*Wear loss of Steel 2-1~2-11
**Wear loss of Steel 1−25

What is claimed is:

1. A pearlitic steel railroad rail consisting essentially of 0.75 to 0.84 weight % C, 0.10 to 1.0 weight % Si, 0.4 to 2.5 weight % Mn, 0.035 weight % or less P, 0.035 weight % or less S, 0.06 to 0.5 weight % Nb, optionally one or more elements selected from the group consisting of 1.5 weight % or less Cr, 1 weight % or less Cu, 1 weight % or less Ni and 1 weight % or less Mo, and a balance of substantially Fe.

2. A pearlitic steel railroad rail consisting essentially of 0.75 to 0.84 weight % C, 0.10 to 1.0 weight % Si, 0.4 to 2.5 weight % Mn, 0.035 weight % or less P, 0.035 weight % or less S, 0.06 to 0.2 weight % Nb, optionally one or more elements selected from the group consisting of 1.5 weight % or less Cr, 1 weight % or less Cu, 1 weight % or less Ni and 1 weight % or less Mo, and a balance of substantially Fe.

3. The pearlitic steel railroad rail of claim 1, wherein C is 0.75 weight %, Si is 0.35 weight %, Mn is 0.952 weight % and Nb is 0.11 weight %.

4. The pearlitic steel railroad rail of claim 1, wherein C is 0.77 weight %, Si is 0.25 weight %, Mn is 0.951 weight %, Nb is 0.09 weight % and Cr is 0.25 weight %.

5. The pearlitic steel railroad rail of claim 1, wherein C is 0.81 weight %, Si is 0.45 weight %, Mn is 0.956 weight % and Nb is 0.07 weight %.

6. The pearlitic steel railroad rail of claim 1, wherein C is 0.84 weight %, Si is 0.25 weight %, Mn is 0.958 weight %, Nb is 0.06 weight % and Cr is 0.2 weight %.

7. The pearlitic steel railroad rail of claim 1, wherein C is 0.82 weight %, Si is 0.91 weight %, Mn is 0.955 weight % and Nb is 0.09 weight %.

8. The pearlitic steel railroad rail of claim 1, wherein C is 0.79 weight %, Si is 0.25 weight %, Mn is 0.951 weight %, Nb is 0.09 weight %, Cu is 0.25 weight % and Ni is 0.12 weight %.

9. The pearlitic steel railroad rail of claim 1, wherein C is 0.81 weight %, Si is 0.29 weight %, Mn is 0.956 weight %, Nb is 0.08 weight % and Mo is 0.34 weight %.

10. The pearlitic steel railroad rail of claim 1, wherein C is 0.84 weight %, Si is 0.23 weight %, Mn is 0.958 weight % and Nb is 0.1 weight %.

11. The pearlitic steel railroad rail of claim 1, wherein C is 0.83 weight %, Si is 0.24 weight %, Mn is 0.45 weight %, Nb is 0.14 weight % and Mo is 0.29 weight %.

12. The pearlitic steel railroad rail of claim 1, wherein C is 0.82 weight %, Si is 0.33 weight %, Mn is 0.85 weight % and Nb is 0.06 weight %.

13. The pearlitic steel railroad rail of claim 1, wherein C is 0.83 weight %, Si is 0.31 weight %, Mn is 1.08 weight % and Nb is 0.08 weight %.

14. The pearlitic steel railroad rail of claim 1, wherein C is 0.84 weight %, Si is 0.32 weight %, Mn is 0.89 weight % and Nb is 0.09 weight %.

15. The pearlitic steel railroad rail of claim 1, wherein C is 0.83 weight %, Si is 0.35 weight %, Mn is 0.95 weight % and Nb is 0.11 weight %.

16. The pearlitic steel railroad rail of claim 1, wherein C is 0.82 weight %, Si is 0.28 weight %, Mn is 0.97 weight % and Nb is 0.14 weight %.

17. The pearlitic steel railroad rail of claim 1, wherein C is 0.81 weight %, Si is 0.31 weight %, Mn is 0.94 weight % and Nb is 0.16 weight %.

18. The pearlitic steel railroad rail of claim 1, wherein C is 0.79 weight %, Si is 0.33 weight %, Mn is 0.99 weight % and Nb is 0.17 weight %.

19. The pearlitic steel railroad rail of claim 1, wherein C is 0.82 weight %, Si is 0.34 weight %, Mn is 1 weight % and Nb is 0.21 weight %.

20. The pearlitic steel railroad rail of claim 1, wherein C is 0.81 weight %, Si is 0.31 weight %, Mn is 0.95 weight % and Nb is 0.45 weight %.

* * * * *